US005809742A

United States Patent [19]

Takakusaki et al.

[11] Patent Number: 5,809,742

[45] Date of Patent: Sep. 22, 1998

[54] CAPPING APPARATUS

[75] Inventors: Nobuyuki Takakusaki; Tomoaki Kaneko, both of Kanagawa-Ken; Toshiaki Naka, Ishikawa-Ken; Seiichi Uchikata, Ishikawa-Ken; Takashi Miyazaki, Ishikawa-Ken, all of Japan

[73] Assignees: Toyo Seikan Kaisha, Ltd., Tokyo; Shibuya Kogyo Co., Ltd., Ishikawa-ken, both of Japan

[21] Appl. No.: 992,640

[22] Filed: Dec. 17, 1997

[30] Foreign Application Priority Data

Mar. 4, 1997 [JP] Japan ..... 9-065296
Mar. 4, 1997 [JP] Japan ..... 9-065297

[51] Int. Cl.[6] ..... B65B 7/28; B67B 3/20

[52] U.S. Cl. ..... 53/317; 53/331.5

[58] Field of Search ..... 53/201, 281, 317, 53/331.5, 490

[56] References Cited

U.S. PATENT DOCUMENTS

| | | | |
|---|---|---|---|
| 3,040,492 | 6/1962 | Stover et al. . | |
| 4,099,361 | 7/1978 | Dix et al. | 53/201 |
| 4,364,218 | 12/1982 | Obrist | 53/331.5 |
| 4,535,583 | 8/1985 | Tanaka et al. . | |
| 4,765,119 | 8/1988 | Aidlin et al. | 53/317 X |
| 5,284,001 | 2/1994 | Ochs | 53/317 X |
| 5,313,765 | 5/1994 | Martin | 53/331.5 X |
| 5,437,139 | 8/1995 | Martin | 53/331.5 X |
| 5,490,369 | 2/1996 | Ellis et al. | 53/331.5 X |
| 5,714,820 | 2/1998 | Mitsuhashi et al. | 53/331.5 X |

*Primary Examiner*—Horace M. Culver
*Attorney, Agent, or Firm*—Flynn, Thiel, Boutell & Tanis, P.C.

[57] ABSTRACT

A capping apparatus includes a capping head 3 which is provided with a rotatable spindle. A plurality of permanent magnets 51 are embedded around the entire outer periphery at the upper end of the spindle, with adjacent permanent magnets 51 presenting magnetic poles of different polarities. An arcuate rotation imparting member 53 is fixedly mounted and includes a plurality of permanent magnets 55 which are disposed along a locus of travel of the permanent magnets 51 on the capping head 3, with adjacent permanent magnets 55 presenting magnetic poles of different polarities. As the capping head 3 moves through a threadable engaging zone C in a direction indicated by an arrow, coaction between the permanent magnets 51 and 55 causes the capping head 3 to rotate clockwise, thereby causing a cap 12 to be threadably engaged with a container 4. The permanent magnets 51 and 55 form together a drive source which is free from a sliding movement, thus preventing a occurrence of abraded powder and avoiding a contamination of the environment of a working area.

7 Claims, 7 Drawing Sheets

55
N
S
N
S
55
3
47
C
53
51
3
N
S
N
S
N
S
52
47
17
55
51
3
17
47
52

CAPPING APPARATUS

FIELD OF THE INVENTION

The invention relates to an improvement of a capping apparatus which attaches a cap around a mouth located at the top end of a container.

DESCRIPTION OF THE PRIOR ART

A capping apparatus is known in the art which comprises a rotatable body disposed in a rotatable manner, a plurality of capping heads disposed around the circumference of the rotatable body in spaced apart relationship from each other, each of the capping heads detachably carrying a cap to cause it to be threadably engaged around a mouth located at the top end of a container; each capping head comprises a holder carrying the capping head a spindle rotatably mounted in a housing and connected to the holder, and a drive source for driving the spindle for rotation.

In a conventional capping apparatus as mentioned above, the capping heads are disposed above containers, and the drive source employs a mechanical arrangement including a sun gear and a motor. A drawback is pointed out with this arrangement in that abraded powder of minimal size is produced in the rotary portions of the sun gear and the motor which are conventionally disposed above containers to cause a contamination of a working area where the capping apparatus is located.

SUMMARY OF THE INVENTION

In view of the foregoing, in accordance with the invention, there is provided a capping apparatus comprising a capping head disposed in a rotatable manner, and a rotation imparting member for causing a rotation of the capping head and carrying a plurality of magnets M1 which are oriented such that alternate magnetic poles are of opposite polarities. The capping head comprises a holder which carries a cap in a detachable manner, a spindle disposed in a rotatable manner and connected with the holder, and a plurality of magnets M2 mounted along the circumference of the spindle and integrally therewith, the magnets M2 being oriented such that alternate magnetic poles thereof are of opposite polarities. A relative movement between the capping head and the rotation imparting member is effective to cause the spindle to rotate under the influence of the magnets M1, M2, thereby threadably engaging a cap with a container.

With the described construction, the combination of the magnets M1 and M2 acts as a drive source for causing the spindle to rotate, and since there is no sliding movement between the magnets M1 and M2, they cannot produce any abraded powder. Consequently, any contamination of a working area in which the capping apparatus is disposed, as caused by the presence of a drive source, can be prevented in a favorable manner.

Above and other objects, features and advantages of the invention will become apparent from the following description of several embodiments thereof with reference to the drawings.

DETAILED DESCRIPTION OF THE EMBODIMENTS

Figure 1:
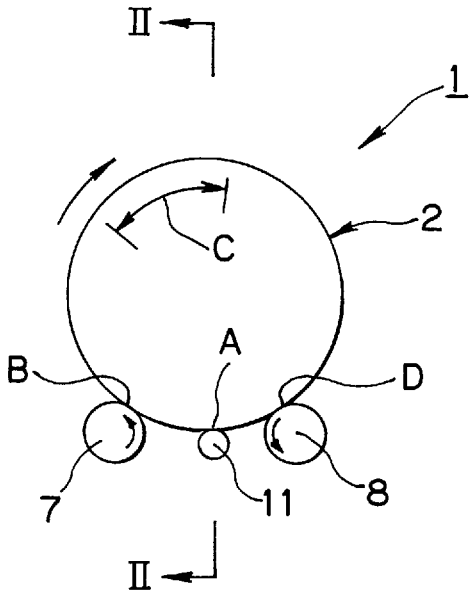
FIG. 1 shows a schematic disposition of an embodiment of the invention.
Figure 2:
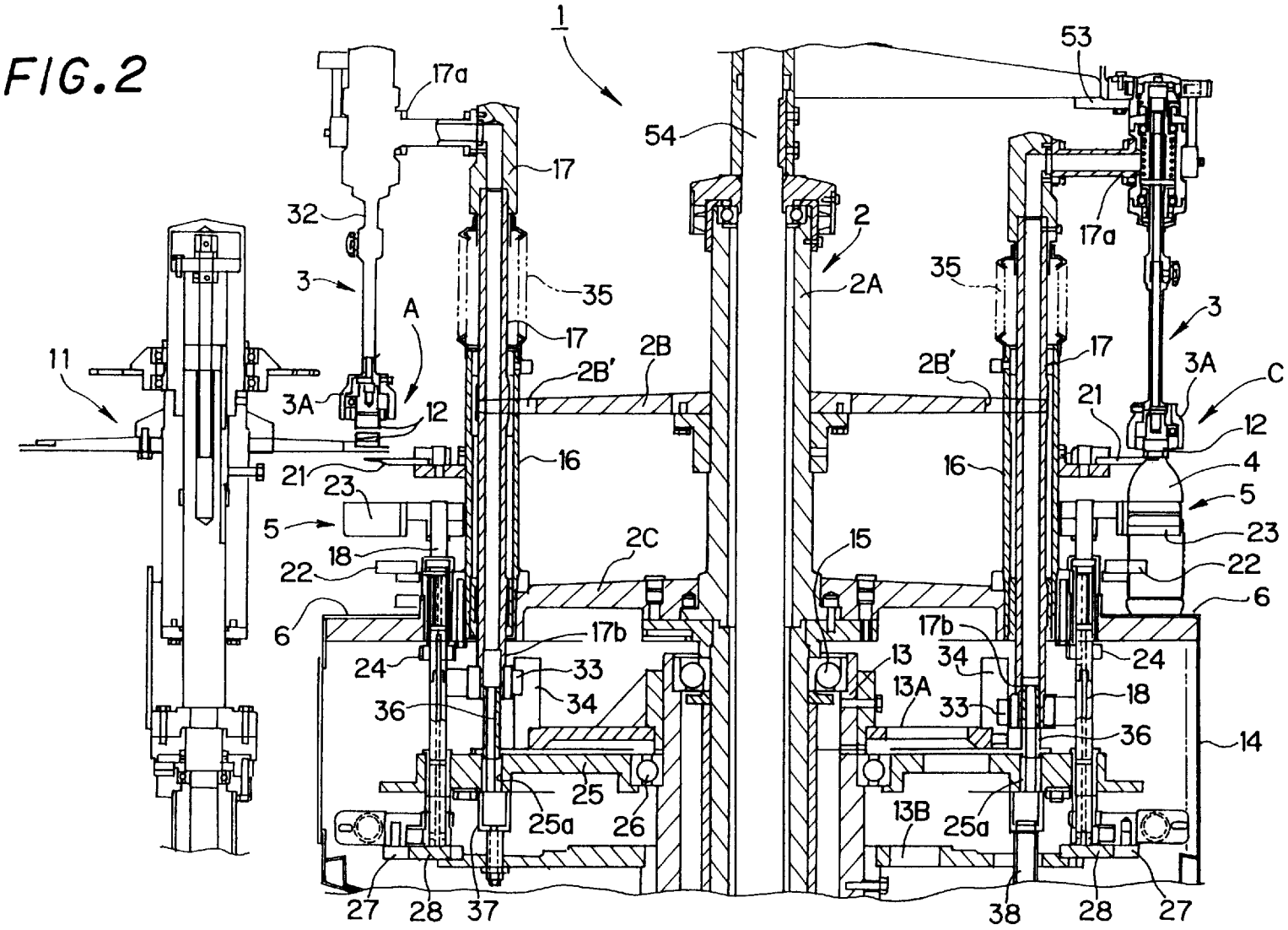
FIG. 2 is a cross section taken along the line II—II shown in FIG. 1.

Referring to the drawings, the invention will be described with reference to the embodiments shown. FIGS. 1 and 2 show a capping apparatus 1 of rotary type, which includes a rotatable body 2 which is driven for continuous rotation in the clockwise direction.

Around the outer periphery of the rotatable body 2, there are disposed a plurality of capping heads 3 which are spaced apart at an equal interval in the circumferential direction, and a receptacle 6 on which a container 4 is placed is disposed below each of the capping heads 3. Clamp means 5 which grips the barrel of the container 4 is disposed below each capping head 3.

As shown in FIG. 1, a feed star-wheel 7 and a discharge star-wheel 8 are disposed adjacent to the rotatable body 2, and a rotary cap feeder 11 which is known in the art is disposed intermediate between the both wheels 7, 8.

Before describing the construction of the capping apparatus 1 in detail, the operation of the capping apparatus 1 in summary will be described. Initially, as the rotatable body 2 rotates in the clockwise direction, a cap 12 is sequentially fed to a position below each capping head 3 from the cap feeder 11 at a cap feeding location A (see FIG. 2). At the cap feeding location A, each capping head 3 holds the cap 12 fed from the cap feeder 11 in the sequential manner.

When the capping head 3 which holds the cap 12 moves to a container feed position B during the rotation of the rotatable body 2, a container 4 is fed onto the receptacle 6 which is disposed below each capping head 3 which holds the cap 12 from the feed star-wheel 7. It is to be noted that the container 4 is filled with a liquid at an upstream step in the process. The container 4 placed on the receptacle 6 is engaged by a pair of stop members 21, 22, to be described later, which engage the neck and the barrel of the container, and has its barrel also gripped by the clamp means 5. In this manner, the container 4 is positioned directly below the cap 12 which is held by the capping head 3.

During the continued rotation of the rotatable body 2, the container 4 on the receptacle 6 and the capping head 3 which is located above the container and holding the cap 12 move into a threadable engaging zone C where each capping head 3 moves down, and because the capping head 3 which holds the cap 12 is itself rotated in the clockwise direction, the cap 12 which is held by a holder 3A is threadably engaged around a mouth located at the top end of the container 4.

When the container 4 to which the cap 12 has been attached in the threadable engaging zone C during the rotation of the rotatable body 2 passes through the zone C, the capping head 3 rises and returns upward to a higher elevation than the top end of the container 4.

As the container 4 to which the cap 12 has been attached is transferred in the downstream direction to a discharge location D by the rotation of the rotatable body 2, the container 4 is released from the grip by the clamp means 5, and is conveyed by the discharge star-wheel 8 from the receptacle 6 to the outside of the rotatable body 2.

The construction of various parts of the capping apparatus 1 will now be described in detail. Referring to FIG. 2, the capping apparatus 1 includes a cylindrical member 13, which is secured in vertically upright position on an anchorage frame, not shown, disposed below the cylindrical member 13. The cylindrical member 13 is provided with a pair of disk-shaped supports 13A, 13B at given elevations around its outer periphery.

On the other hand, the rotatable body 2 includes a cylinder 2A which represents the center of rotation, a disk-shaped support 2B which is connected to the outer periphery of the cylinder 2A in an upper region, and another disk-shaped support 2C connected to the cylinder 2A at a lower elevation than the support 2B. The cylinder 2A of the rotatable body 2 is rotatably journalled in the cylindrical member 13 by a pair of upper and lower bearings 15 (only upper one being shown).

The upper surface of the support 2C of the rotatable body 2 in a region toward the outer periphery is used as the receptacle 6, and the upper end of a cylindrical cover 14 is connected to the outer peripheral edge of the support 2C, thus surrounding various parts which are disposed below the support 2C.

Tubular guides 16 are mounted in vertically upright position on the support 2C at an equal spacing circumferentially, and the outer periphery of these tubular guides 16 at their upper ends engages notches 2B' formed in the support 2B. A pipe 17 associated with the capping head 3 to be described later slidably extends through each tubular guide 16.

A first stop member 21 is mounted on the outer periphery of the tubular guide 16 at a location slightly below the support 2B and is directed outwardly. Similarly, a second stop member 22 is mounted at a location which is below the first stop member 21. Outer extremities of the both stop members 21, 22 are shaped to be concave in conformity to the shape of the container. Accordingly, when the container 4 is supplied to the receptacle 6, the neck of the container 4 is engaged by the concave portion at the extremity of the first stop member 21, and the barrel of the container 4 is engaged by the concave portion at the extremity of the second stop member 22, thus positioning the container 4 on the receptacle 6. The clamp means 5 grips the barrel of the container 4 to prevent a displacement of the positioned container 4.

The clamp means 5 includes a pair of clamp members 23 which grip the container 4, and a pair of left and right rotary shafts 18 having the clamp members 23 connected to their upper ends. It is to be noted that in FIG. 2, only one of the clamp members 23 of each pair is visible.

Each rotary shaft 18 extends through the second stop member 22 and the support 2C, and is supported at the given locations of these members to be rotatable. Gears 24 of a small diameter are mounted on the left and the right rotary shaft 18, and adjacent gears 24 mesh each other. In this manner, the clamp members 23 connected to respective rotary shafts 18 are allowed to be opened or closed in synchronism with each other.

An annular member 25 in the form of a circle is disposed below the support 13A which represents the stationary part, and the lower portion of each rotary shaft 18 extends through the annular member 25 toward its outer periphery.

The annular member 25 contains a tubular bearing or the like which allows each rotary shaft 18 to be rotatable. A given spacing is maintained between the annular member 25 and the stationary support 13A. In this manner, the annular member 25 is connected to the support 2C of the rotatable body 2 through the respective rotary shafts 18, and thus rotates together with the rotatable body 2. In order to assure a smooth rotation of the annular member 25, a bearing 26 is interposed between the inner periphery of the annular member 25 and the stationary tubular member 13.

A cam follower 27 is rotatably mounted on the bottom end of one of the rotary shafts 18 of the pair through a bracket. An annular cam member 28 is mounted on the stationary support 13B toward its outer periphery, and has a cam surface with which the cam follower 27 is disposed in rolling engagement.

In this manner, each clamp means 5 used in the present embodiment comprises the pair of left and right clamp members 23, the pair of rotary shafts 18 connected thereto, the cam follower 27 and the cam member 28.

When the rotatable body 2 rotates clockwise, in an angular region which extends from a position slightly passed the container feeding location B and to a position slightly short of the discharge location D, the cam member 28 causes each pair of clamp members 23 of the respective clamp means 5 to be closed, thus gripping the barrel of the container 4 placed on the receptacle 6 by the pair of clamp members 23 (see FIG. 2). By contrast, in an angular region from the discharge location D to the container feed location B during the rotation of the rotatable body 2, the cam member 28 allows the respective clamp members 23 to be opened, whereby the container 4 can be discharged from the receptacle 6 to the outside of the rotatable body at the discharge location D. The barrel of the container 4 which is supplied to the receptacle 6 at the container feed location B is inserted between the pair of clamp members 23.

In the present embodiment, the magnetic force is used as a drive source which causes each capping head 3 to rotate in order to prevent abraded powder from being produced from the drive source comprising the capping head.

Figure 3:
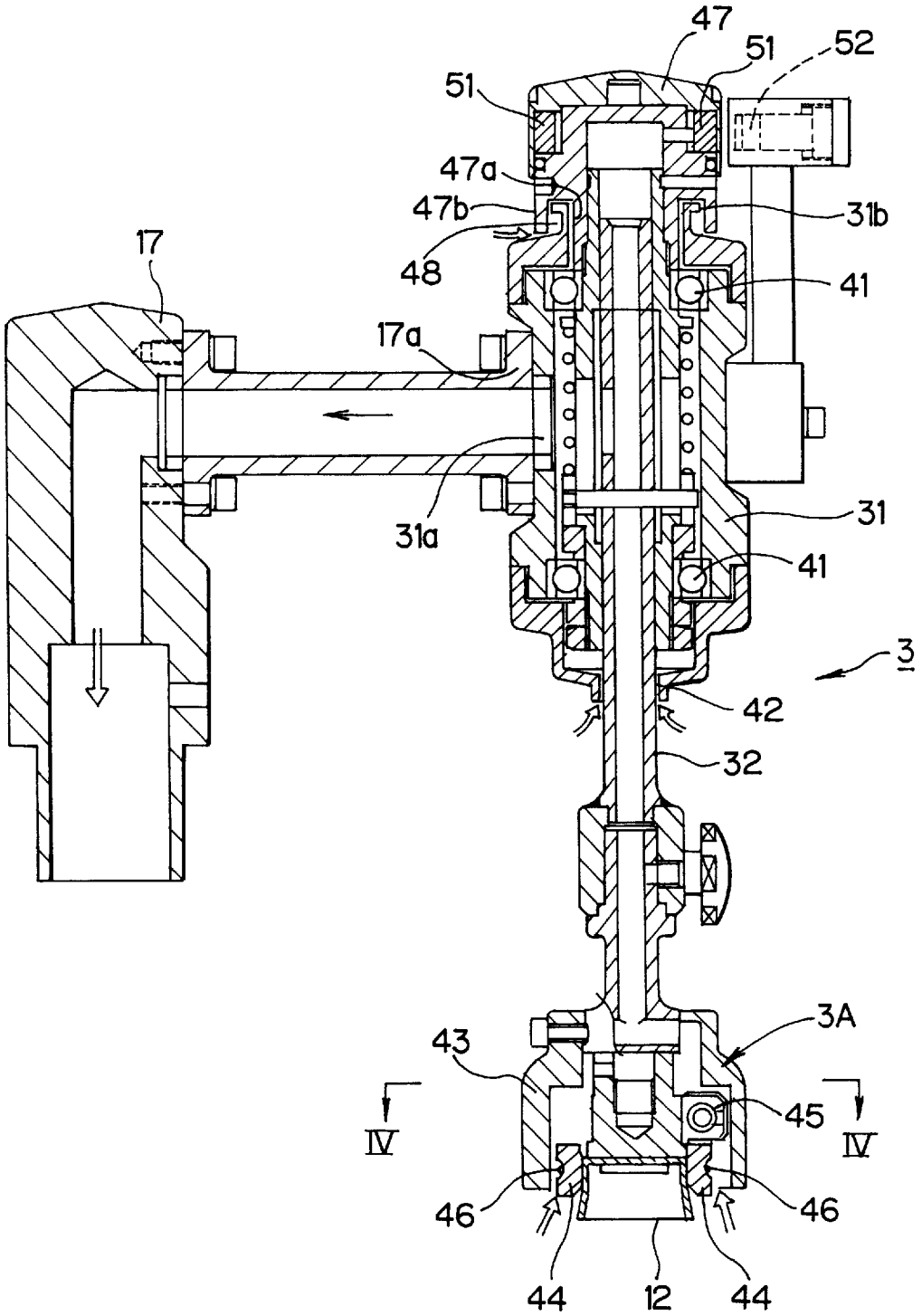
FIG. 3 is an enlarged view of a pertinent section shown in FIG. 2.

Specifically, referring to FIGS. 2 and 3, the capping head 3 comprises a stepped cylindrical housing 31, a pipe 17 having one end 17*a* which extends horizontally connected to the housing 31, and a spindle 32 which is rotatably carried by the housing 31. The holder 3A which detachably holds a cap 12 is connected to the bottom end of the spindle 32.

The lower end 17*b* of the pipe 17 has a cam follower 33 rotatably mounted thereon, which is placed on a cam surface of an annular cam member 34 which is mounted on the stationary support 13A.

The cam member 34 is designed to lower the entire capping head 3 to its down position where this elevation is maintained in an angular region of the resolving body 2 during its rotation in the clockwise direction which extends downstream from the cap feed location A and including the threadable engaging zone C. On the other hand, in the remaining angular region of the resolving body 2, the cam member 34 maintains the entire capping head 3 at its up end position. At the cap feed location A where the capping head 3 assumes its down position, the holder 3A holds the cap 12 while in the threadable engaging zone C, the cap 12 held by the holder 3A of the capping head 3 is allowed to threadably engage around a mouth located at the top end of the container 4. On the other hand, when the capping head 3 is located at its up end position, the holder 3A of the capping head 3 is maintained by a given amount above the mouth at the top end of the container 4 which is placed on the receptacle 6. A buffering spring 35 is disposed between the outer periphery of the pipe 17 at its upper portion and the upper end of the tubular guide 16.

As shown in FIG. 3, the housing 31 is formed with a radial through-hole 31*a* at an axially central location along the length thereof, and the end 17*a* of the pipe 17 is connected to the housing 31 in surrounding relationship with the through-opening 31*a* while maintaining a hermetic seal, whereby the pipe 17 communicates with the internal space of the housing 31.

On the other hand, the annular member 25 is formed with a through-opening 25*a* at each position which is located below the lower end 17*b* of the pipe 17, and a connection pipe 36 of a small diameter has its lower end fitted into the upper end of the through-opening 25*a*. The upper end of the connection pipe 36 is slidably fitted into the lower end 17*b* of the pipe 17 so that a hermetic seal is maintained between the outer periphery of the pipe 36 and the inner periphery of the pipe 17.

Individual through-holes 25*a* are formed in the annular member 25 at locations which lie on a concentric circle, and a duct member 37 which is U-shaped in section is disposed below the concentric circle. The bottom of the duct member 37 is connected to the stationary support 13B through a bracket. In this manner, the upper inner and outer edges of the duct member 37 are held in close contact with the bottom surface of the annular member 25 at locations inside and outside the respective through-openings 25*a*. Under this condition, the annular member 25 is disposed for sliding contact while maintaining a hermetic seal with respect to the upper edges of the duct member 37. The duct member 37 communicates with a source of negative pressure, not shown, through a separate pipe 38.

In this manner, a communication is established between the internal space of the housing 31 and the source of negative pressure, not shown, in the present embodiment through the pipe 17, the connection pipe 36, the respective through-holes 25*a* formed in the annular member 25, an annular space surrounded by a combination of the duct member 37 and the bottom surface of the annular member 25 and the pipe 38, thus normally introducing a negative pressure from the source into the internal space of the housing 31. With this arrangement, if abraded powder of minimal size is produced by a rotating part within the housing 31, such powder will be drawn by the negative pressure, thus preventing abraded powder of minimum size from being scattered outside the housing 31.

The spindle 32 is internally hollow, and a pair of upper and lower ball bearings 41 are disposed between the inner periphery of the housing 31 and the outer periphery of the spindle 32 disposed within the housing 31 at its upper and lower ends. The ball bearings 41 allow the spindle 32 to be rotatable relative to the housing 31 while maintaining the spindle 32 at a given elevation with respect to the housing 31. A radial through-hole is formed in the spindle 32, which is disposed within the housing 31, at a given location, thereby providing a communication between the internal space of the spindle 32 and the internal space of the housing 31.

The lower end of the housing 31 has a reduced diameter as compared with an upper portion thereof, and the lower portion of the spindle 32 extends through the lower end of the housing 31 which has the reduced diameter. An annular clearance 42 is maintained between the inner peripheral surface of the housing 31 at its lower end and the outer peripheral surface of the spindle 32 which is disposed therein. As mentioned above, the negative pressure is normally introduced into the housing 31, and accordingly, the atmosphere is drawn into the housing 31 through the clearance 42.

Figure 4:
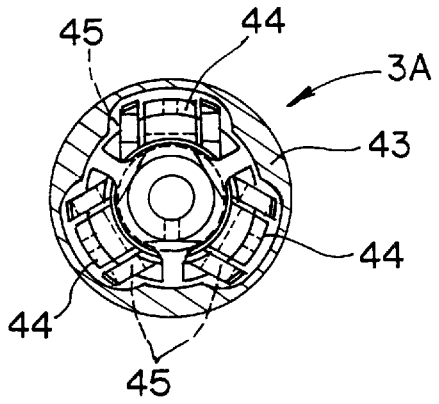
FIG. 4 is a cross section taken along the line IV—IV shown in FIG. 3.

The holder 3A at the lower end of the spindle 32 will now be described. Referring to FIGS. 3 and 4, the holder 3A includes a generally cup-shaped housing 43 in which a set of three engaging members 44 are disposed. A support shaft 45 associated with the housing 43 extends through upper portions of the set of engaging members 44, whereby the engaging members 44 are allowed to rock about the support shafts 45. An arcuate spring 46 is attached to each engaging member 44 so as to surround a lower portion thereof for urging the lower portion of each engaging member 44 inward.

With the described construction, when the holder 3A which does not hold a cap 12 is lowered, the cap 12 which is disposed below it is allowed to be held by each engaging member 44 since the spring 46 is forced open by the cap 12. On the other hand, when the holder 3A is rotated subsequently, and when the holder 3A is raised again after the cap 12 has been attached around a mouth located at the top end of the container 4, the cap holding action by the engaging members 44 is terminated because of a reduced force of friction acting between the engaging members 44 and the cap 12.

As shown in FIG. 3, the inner portion of the housing 43 of the holder 3A communicates with the internal space of the spindle 32, and accordingly, when the negative pressure is introduced into the housing 31 of the capping head 3, the atmosphere is drawn through an opening located at the lower end of the housing 43 of the holder 3A to be drawn into the pipe 17 through the internal space of the spindle 32 and through the internal space of the housing 31.

The upper end of the spindle 32 extends through the housing 31 and projects above it, and a generally cup-shaped support member 47 is connected to the top end of the spindle 32. At its bottom, the support member 47 is formed with a downwardly depending inner tubular portion 47*a* and an outer tubular portion 47*b*, the inner tubular portion 47*a* being fitted around the outer periphery of the spindle 32 at its top end while being simultaneously inserted into the housing 31. The upper end of the housing 31 has an outer periphery 31*b* which extends slightly radially outward to define a flange. The outer periphery 31*b* at the upper end and the outer periphery located adjacent to and below it are surrounded by the outer tubular portion 47*b* and the inner tubular portion 47*a* of the support member 47 as well as a boundary region therebetween. With this construction, an annular clearance 48 is formed between the inner periphery of the housing 31 at its upper end and its adjacent lower portion on one hand and the inner tubular portion 47*a* and the outer tubular portion 47*b* of the support member 47 which are disposed opposite to the just mentioned inner periphery as well as a boundary region therebetween on the other hand. By forming the outer periphery 31*b* at the upper end of the housing 31 in the form of a flange, the clearance 48 is substantially in a labyrinth configuration. Since the negative pressure is introduced into the housing 31, the atmosphere can be drawn into the housing 31 through the clearance 48.

Figure 5:
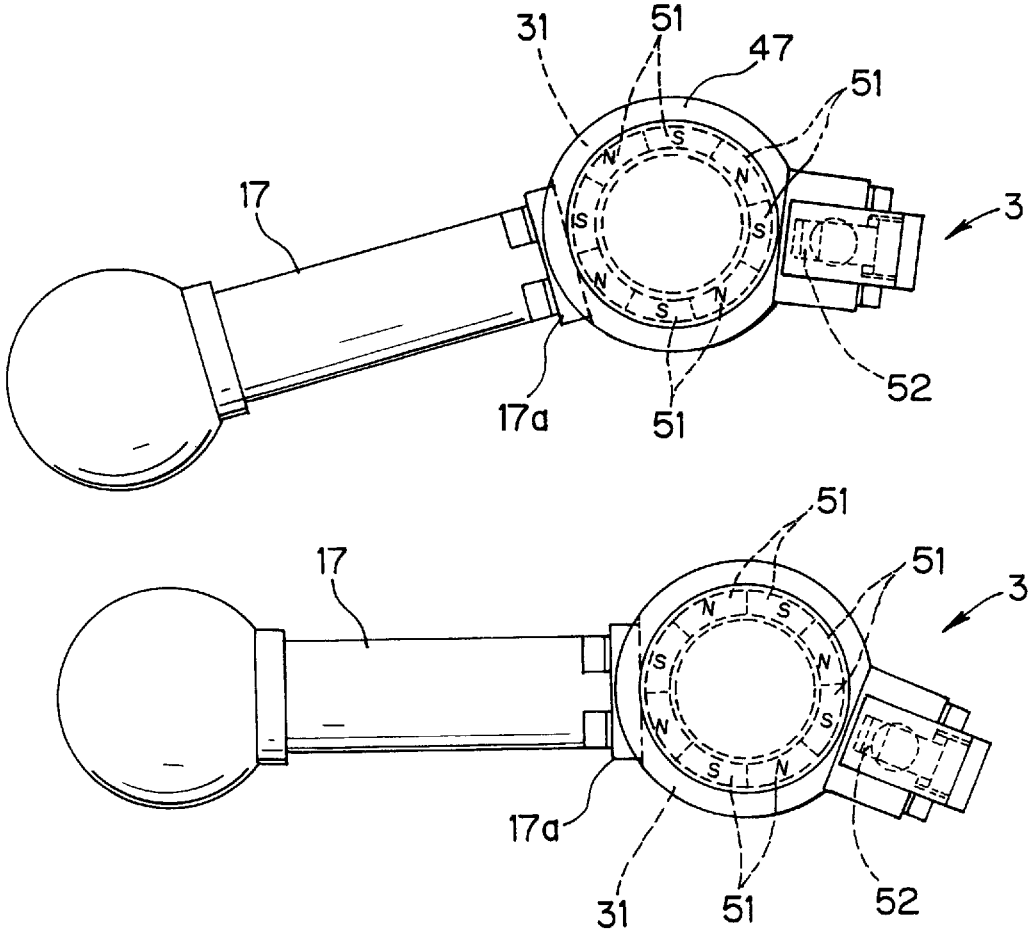
FIG. 5 is a plan view showing the disposition in the circumferential direction of the pertinent section shown in FIG. 3.

Referring to FIGS. 3 and 5, a plurality of arcuate permanent magnets 51, which are eight in number, are embedded in the entire outer periphery at the upper end of the support member 47. As shown in FIG. 5, the permanent magnets 51 are oriented such that permanent magnets which are adjacent to each other present magnetic poles of different polarities.

A positioning permanent magnet 52 is supported on the upper end of a bracket connected to the housing 31 at a location adjacent to and outward of the support member 47 carrying the permanent magnets 51. The permanent magnet 52 may present a magnetic pole, for example, N-pole.

Referring to FIGS. 2 to 6, an arcuate rotation imparting member 53 is disposed across the entire threadable engaging zone C. As shown in FIG. 2, a support shaft 54 which is fixedly mounted on the anchorage frame, not shown, extends through the cylinder 2A of the rotatable body 2, and the rotation imparting member 53 is connected to the upper end of the support shaft 54 through a bracket. The rotation imparting member 53 is supported in a horizontal position and is located inside and adjacent to a locus of travel of the support member 47 carrying the permanent magnets 51. A plurality of permanent magnets 55 are disposed in the outer edge of the rotation imparting member 53, in a row adjacent to each other along the locus of travel of the support member 47. The permanent magnets 55 are also oriented such that adjacent permanent magnet present magnetic poles of opposite polarities.

Figure 6:
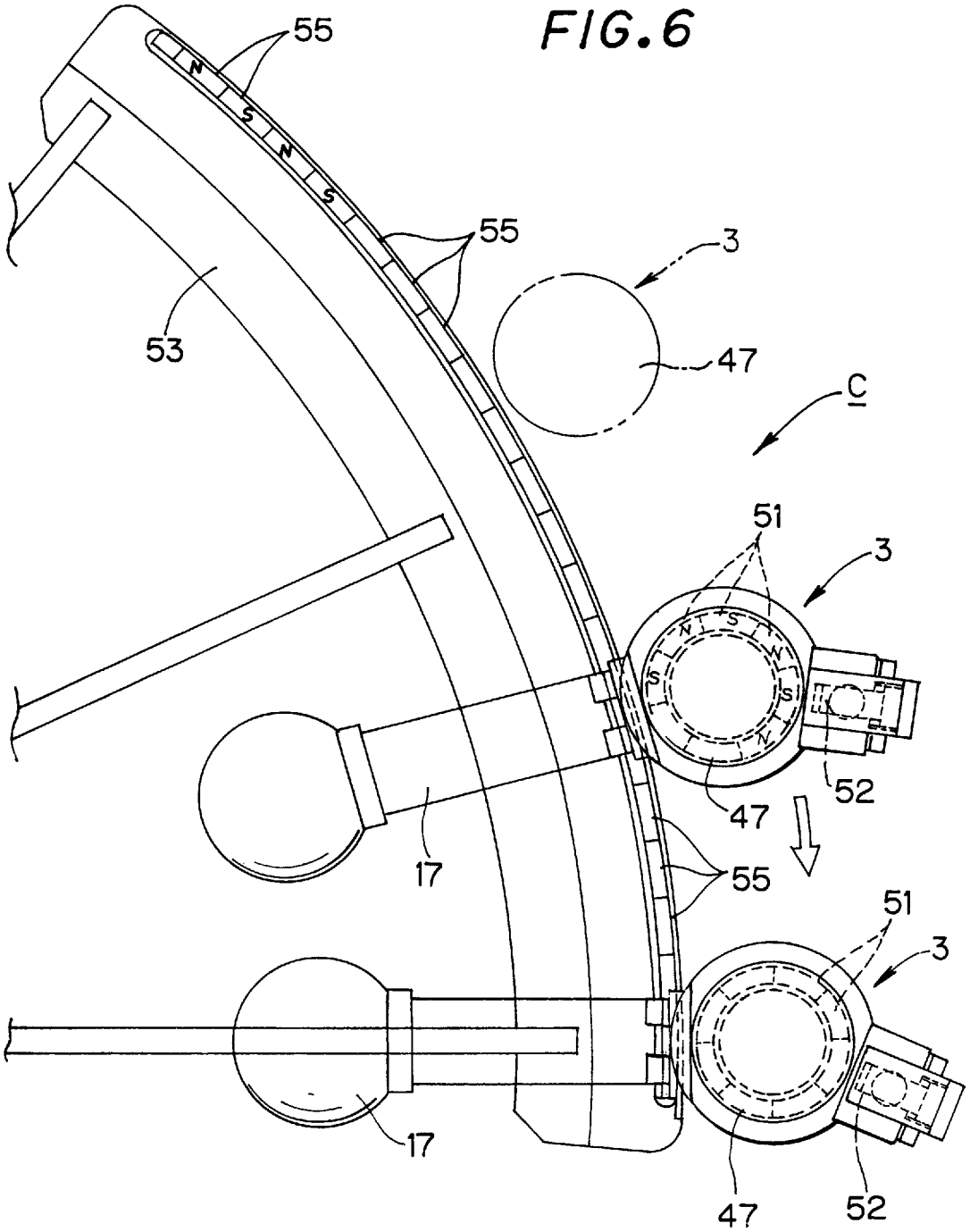
FIG. 6 is a plan view of a pertinent section shown in FIG. 2.

As a result of the construction mentioned above, in the present embodiment, as the capping head 3 moves through the threadable engaging zone C, the magnetic force from the permanent magnet on the capping head 3 and the magnetic force from the permanent magnet 55 on the stationary part coact each other to cause the capping head 3 to rotate clockwise in the threadable engaging zone C, as illustrated in FIG. 6.

As mentioned previously, the positioning permanent magnet 52 is disposed adjacent to the capping head 3. When the capping head 3 is located upstream of the threadable engaging zone C, the positioning permanent magnet 52 and one of the permanent magnets 51 on the support member 47 attract each other to determine an angular position assumed before the capping head 3 rotates about its own axis. This assures that the capping head 3 never fails to rotate clockwise when it moves through the threadable engaging zone C.

In the present embodiment, the plurality of permanent magnets 55 on the stationary part and the permanent magnets 51 on the spindle 32 of the capping head 3 form together a drive source which causes the spindle 32 to rotate.

The described arrangement assures that as the capping head 3 having a cap 12 held by the holder 3A moves through the threadable engaging zone C, the spindle 32 rotates clockwise and the cam member 33 causes the capping head 3 itself to be lowered, whereby the cap 12 held by the holder 3A is brought into threadable engagement around a mouth located at the top end of the container 4.

It will be noted that the drive source which is used in the present embodiment to rotate the spindle 32 does not have parts which undergo a relative rotation to cause an attrition. Hence, there is no occurrence of abraded powder of minimal size produced by a drive source used for the capping head 3, and thus there is no likelihood that a working area in which the capping apparatus 1 is disposed may be contaminated by such abraded powder.

In addition, in the present embodiment, an arrangement is provided such that a negative pressure is normally introduced into the housing 31, thus allowing the atmosphere to be drawn into the housing 31 through clearances 48, 42 defined at the upper and the lower end of the housing 31 and through an opening formed in the bottom of the holder 3A. The atmosphere which is drawn into the housing 31 is externally discharged through the pipe 17 mentioned above. By drawing the atmosphere into the holder 3A and the housing 31 by means of the negative pressure, if abraded powder of minimal size is produced by frictional parts within the holder 3A and the housing 31, such abraded powder is prevented from being scattered externally through the bottom opening in the holder 3A or the openings at the upper and the lower end of the housing 31. In this manner, a contamination of a working area in which the capping apparatus 1 is disposed by the presence of abraded powder can be prevented in a favorable manner.

In the present embodiment, the magnets are used to act as a drive source for the capping head 3, thus preventing the occurrence of abraded powder from the drive source. In this manner, the operational environment of the capping apparatus 1 can be maintained in a good condition as compared with the prior art. If abraded powder of minimal size is produced within the capping head 3, the good working environment can be maintained by introducing a negative pressure into the housing 31 to draw such abraded powder.

Second Embodiment

Figure 7:
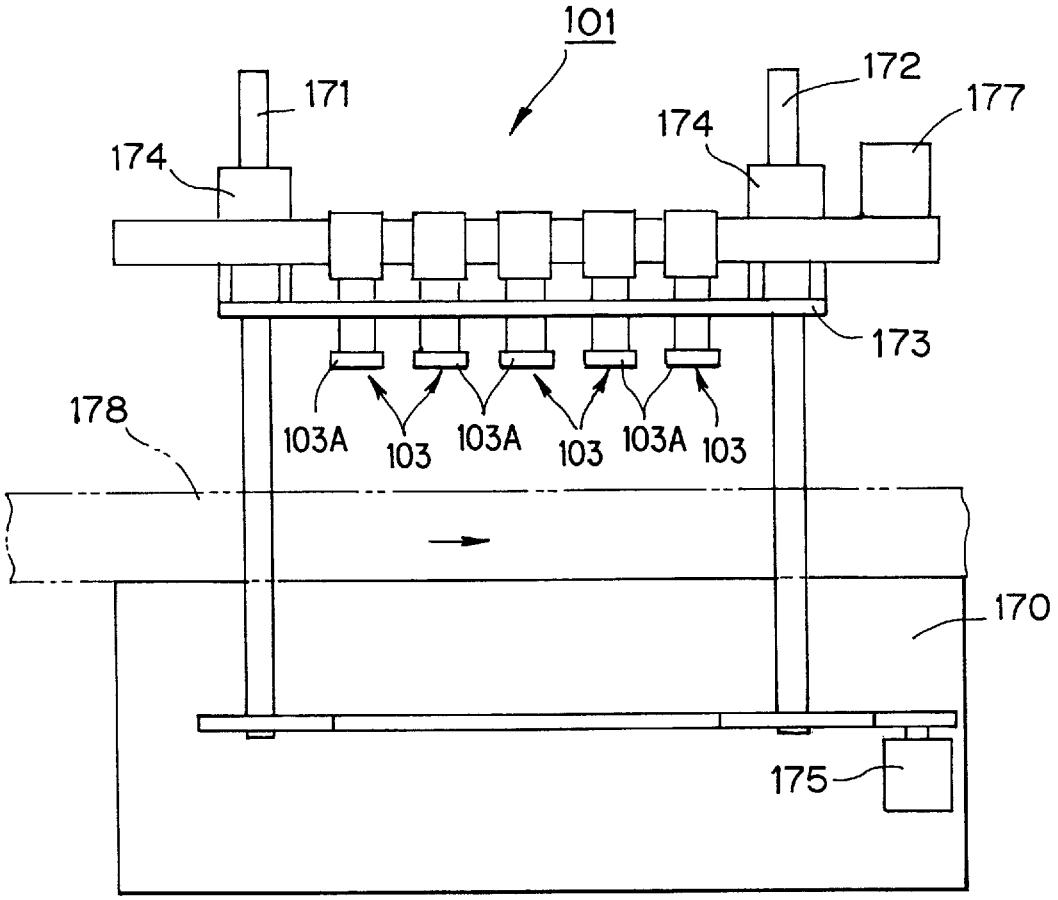
FIG. 7 is a front view of another embodiment of the invention.
Figure 8:
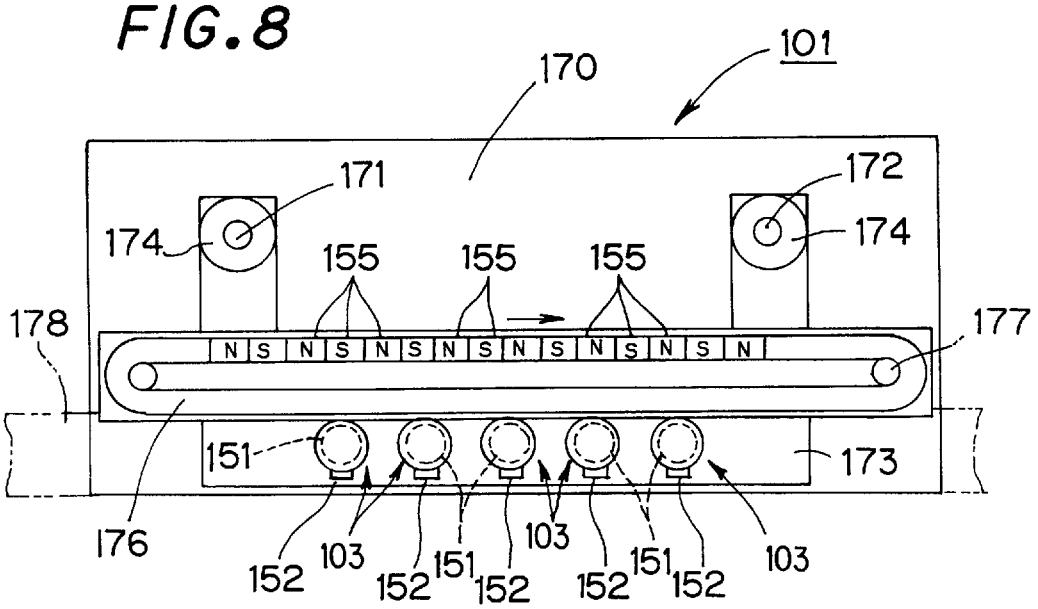
FIG. 8 is a plan view of the embodiment shown in FIG. 7.
Figure 9:
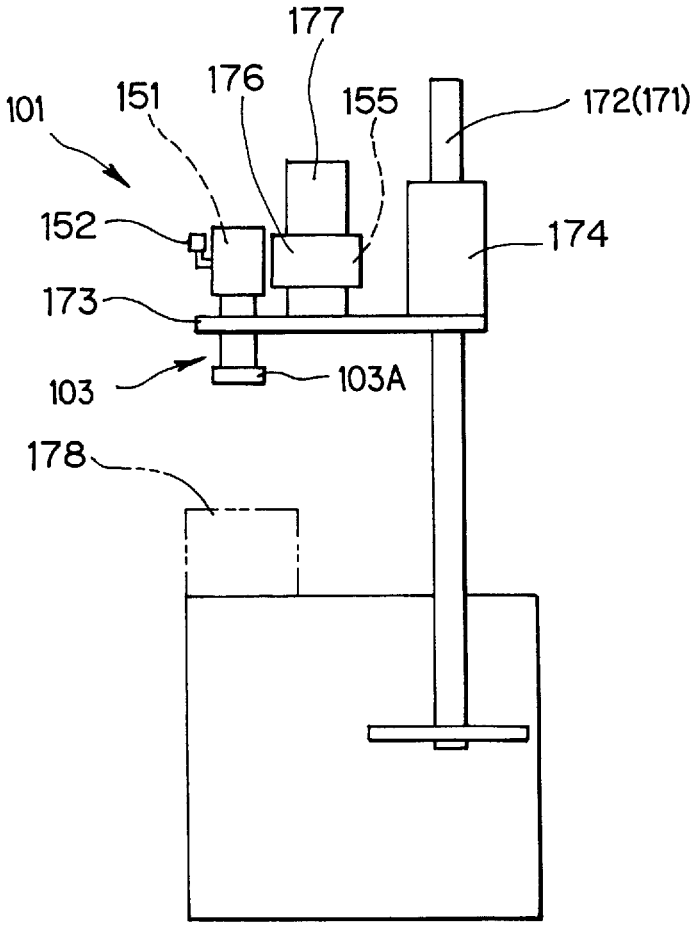
FIG. 9 is a right-hand side elevation of the embodiment shown in FIG. 7.

FIGS. 7 to 9 show a second embodiment of the invention. While the first embodiment illustrated the application of the invention to a rotary capping apparatus 1 in which the capping head 3 rotate together with the rotatable body 2, the second embodiment illustrates the application of the invention to a capping apparatus 101 of so-called line type.

Specifically, in the second embodiment, a pair of threaded shafts 171, 172 are rotatably mounted on a frame 170 in vertically upright position with a given spacing therebetween. Five capping heads 103 are mounted on a plate-shaped elevator member 173 at an equal spacing in a linear array lengthwise thereof. A pair of nut members 174 connected to the elevator member 173 are threadably engaged with the threaded shafts 171, 172. The threaded shafts 171, 172 are mechanically coupled to a motor 175 mounted on the frame 170. By energizing the motor 175 for rotation in either forward or reverse direction, the elevator member 173 and the capping heads 103 mounted thereon can be elevated through a given stroke.

The construction of each capping head 103 remains the same as that shown in FIG. 3, and hence will not be specifically described. However, each capping head 103 is rotatably mounted on the elevator member 173 with its holder 103A directed downward. In FIGS. 7 to 9, each capping head 103 is shown in simplified form, but it should be understood that a plurality of permanent magnets 151 which present alternately magnetic poles of different polarities are mounted around the outer periphery at the upper end of the spindle of each capping head 103 and that a positioning permanent magnet 152 is disposed adjacent thereto.

A pair of belt pulleys are mounted on the upper surface of the elevator member 173, and an endless belt 176 extends around these pulleys. It will be noted that the endless belt 176 extends along the direction in which the individual capping heads 103 are disposed and is driven by a motor 177 to run in a direction indicated by an arrow. A plurality of permanent magnets 155 presenting alternately magnetic poles of opposite polarities are embedded in a given region of the belt 176. It will be noted that a conveyor 178 on which containers are placed to be conveyed in a direction indicated by an arrow intermittently as well as grippers (not shown) are disposed below the locations of respective capping heads 103.

In the second embodiment constructed in the manner mentioned above, the drive motor 177 causes the belt 176 to run in the direction of the arrow, whereby the magnetic force from the permanent magnets 155 mounted on the belt 176 and the magnetic force from the permanent magnets 151 on the capping heads 103 coact each other to rotate the spindle associated with each capping head 103 to rotate in the given direction. In this manner, a cap which is fed from a cap feeder, not shown, and which is held by a holder 103A of the capping head can be threadably engaged around a mouth located at the top end of a container. The second embodiment achieves the similar functioning and advantage as achieved by the first embodiment. It should be noted that parts corresponding to those shown in the first embodiment are designated by like reference numerals and characters in the second embodiment, to which 100 is added.

In the first embodiment mentioned above, the rotation imparting member 53 on which the permanent magnets 55 are disposed is located inwardly of the locus of travel of the capping heads 3, but it should be understood that where the rotatable body 2 is rotated counter-clockwise, the rotation imparting member 53 is located outwardly of the locus of travel of the capping heads 3.

While the invention has been disclosed above in connection with several embodiments thereof, it should be understood that a number of changes, modifications and substitutions therein are possible without departing from the spirit and the scope of the invention defined by the appended claims.

What is claimed is:

1. A capping apparatus comprising a capping head disposed in a rotatable manner, and a rotation imparting member for causing the capping head to rotate, the rotation imparting member including a plurality of magnets M1 which are arranged to present alternate magnetic poles of opposite polarities, the capping head including a holder detachably holding a cap, a spindle connected to the holder and disposed in a rotatable manner, and a plurality of magnets M2 disposed integrally with and along the circumference of the spindle and presenting alternate magnetic poles of opposite polarities, a relative movement between the capping head and the rotation imparting member being effective to cause the spindle to be rotated by the cooperation between the magnets M1 and M2 to threadably engage the cap with the container.

2. A capping apparatus according to claim 1 in which a plurality of said capping heads are disposed at a plurality of locations along the circumference of a rotatable body which is disposed to be rotatable, the rotation imparting member being fixedly mounted along a locus of travel of the capping heads as the rotatable body is rotated.

3. A capping apparatus according to claim 1 in which the capping head is disposed in the rotatable manner at a given location while the rotation imparting member is disposed to be movable in the tangential direction thereof.

4. A capping apparatus according to claim 1, further comprising positioning means for positioning the magnets M2 on the spindle before the spindle is rotated by the cooperation between the magnets M1 and M2.

5. A capping apparatus according to claim 4 in which the positioning means comprises a magnet M3 disposed at a given location.

6. A capping apparatus according to claim 1 in which the capping head includes a housing which rotatably supports the spindle, an arrangement being provided such that a negative pressure is applied to the internal space of the holder and to the internal space of the housing to draw the atmosphere into the respective internal spaces.

7. A capping apparatus according to claim 6 in which the spindle extends through the housing and is rotatably journalled, clearances being defined between the inner periphery of the ho using at its upper and lower ends and the outer periphery of the spindle at its upper and lower ends to draw the atmosphere into the housing.

* * * * *